US008312747B2

(12) United States Patent
Hedegaard

(10) Patent No.: US 8,312,747 B2
(45) Date of Patent: Nov. 20, 2012

(54) TUMBLER FOR TUMBLING BODIES OF DEAD FURRED ANIMALS

(75) Inventor: Jens Hedegaard, Holstebro (DK)

(73) Assignee: Dansk Mink Papir A/S, Holstebro (DK)

( * ) Notice: Subject to any disclaimer, the term of this patent is extended or adjusted under 35 U.S.C. 154(b) by 26 days.

(21) Appl. No.: 12/528,343

(22) PCT Filed: Feb. 18, 2008

(86) PCT No.: PCT/DK2008/050040
§ 371 (c)(1),
(2), (4) Date: Dec. 9, 2010

(87) PCT Pub. No.: WO2008/101505
PCT Pub. Date: Aug. 28, 2008

(65) Prior Publication Data

US 2011/0132044 A1 Jun. 9, 2011

(30) Foreign Application Priority Data

Feb. 22, 2007 (DK) ..... 2007 00285

(51) Int. Cl.
*C14C 15/00* (2006.01)

(52) U.S. Cl. ..... 69/30; 69/32

(58) Field of Classification Search ..... 69/1, 22, 69/23, 30, 32; 68/139, 143, 145; 134/120
See application file for complete search history.

(56) References Cited

U.S. PATENT DOCUMENTS

| | | | | |
|---|---|---|---|---|
| 2,282,530 | A * | 5/1942 | Plass | 69/23 |
| 3,803,882 | A * | 4/1974 | Brennan | 68/208 |
| 4,984,438 | A * | 1/1991 | Batty | 68/27 |
| 5,307,652 | A * | 5/1994 | Hagiwara et al. | 68/27 |
| 5,333,475 | A * | 8/1994 | Edmundson et al. | 68/27 |
| 5,570,597 | A * | 11/1996 | Bongini et al. | 68/17 R |
| 6,684,441 | B2 * | 2/2004 | Mehrmann et al. | 8/158 |
| 6,792,777 | B2 * | 9/2004 | Shaw et al. | 68/210 |
| 6,935,144 | B2 * | 8/2005 | Lakshmanan et al. | 69/30 |
| 2004/0182118 | A1 * | 9/2004 | Lakshmanan et al. | 69/30 |

FOREIGN PATENT DOCUMENTS

| | | |
|---|---|---|
| AU | 43021/85 A | 12/1985 |
| GB | 283 709 A | 1/1928 |
| GB | 1 271 931 A | 4/1972 |

* cited by examiner

*Primary Examiner* — Shaun R Hurley
(74) *Attorney, Agent, or Firm* — Roberts Mlotkowski; Safran & Cole, P.C.; David S. Safran

(57) ABSTRACT

In connection with the tumbling of the bodies of killed furred animals, a tumbler (2) has a cavity (21) between A filling opening (20) and A delivery opening (26) that is divided into a number of sections (30, 32) to which the bodies are transferred by a conveyor unit (36) that extends through the tumbler (2), combined with a discharge/recycling arrangement (28) for individual and controlled discharge of the bodies from the tumbler. The conveyor unit (36) also has a bottom section with a worm conveyor for recirculation of the supply of sawdust to the respective sections. The tumbler (2) can be emptied and filled without having to stop operations, and is suitable for use for tumbling of pelts with the leather side outermost or with the fur side outermost, so that the tumbler replaces two or three tumblers which normally are found in a pelt processing plant.

12 Claims, 5 Drawing Sheets

TUMBLER FOR TUMBLING BODIES OF DEAD FURRED ANIMALS

BACKGROUND OF THE INVENTION

1. Field of Invention

The present invention relates to a tumbler for tumbling bodies of killed furred animals, and comprising a cavity which is defined by a substantially cylindrical, horizontally-oriented tube which is limited by a first and a second end wall, respectively comprising a feed-in opening for the bodies of mink and a discharge opening, said tumbler being made to rotate around its horizontal axis by means of a motor-driven drive mechanism, and where the inner wall of said tumbler comprises a number of carriers.

2. Description of Related Art

In UK Patent Application GB 1271931 A (Cyril Norris & Son Ltd) there is disclosed a tumbler with a helical transport arrangement for the handling of pelts and other articles. The tumbler has two ends which comprise a feed-in opening and a discharge opening. A chute is placed in the discharge opening for the removal of the pelts, and the inner wall of the tumbler is provided with carriers. The tumbler is provided with a helical transport unit which ensures that the pelts are fed continuously from the feed-in opening to the discharge opening.

Such tumblers are used in connection with the production of pelts, where the killed furred animals are laid for cooling before the actual skinning takes place. It is necessary, however, to carry out a mechanical handling of the dead bodies before the skinning is carried out. The tumbling of the bodies takes place immediately after the animals are killed, and is carried out together with a liquid-absorbing particulate medium, which most often consists of sawdust, which has good absorption characteristics, while at the same time being inexpensive to procure. With the tumbling of the not-yet cooled bodies, saliva, urine, faeces and other impurities are removed from the bodies, so that the presence of these impurities does not reduce the quality of the pelts and be of any inconvenience during the subsequent skinning of the killed animals.

During the skinning season, there are sometimes killed a greater number of animals than it is possible to skin, with the result that there is typically undertaken a cooling of the bodies for later skinning. There will herewith arise a stiffness in the bodies, which it is desirable to eliminate before the skinning takes place, inasmuch as the skinning of stiff dead bodies of furred animals is difficult and time consuming. Therefore, it will be expedient to remove said stiffness, which can be done by carrying out a mechanical handling of the bodies, and for this purpose use is once again made of tumblers.

The tumbling of the bodies takes place together with a suitable particulate material, e.g., sawdust, in order to absorb the fluids as mentioned above, with the result that dust is formed in the room in which the tumbling is carried out. The tumblers which are known today function in accordance with the batch principle, i.e. a certain number of bodies are fed into the tumbler together with a certain amount of sawdust, after which the tumbler is closed and set in operation. The tumbling of the bodies is implemented over a certain period of time, after which the bodies are removed from the tumbler. Some of the known types of tumblers require that their rotation be actually stopped, manual removal of the tumbled bodies and filling with a new batch of bodies to be tumbled. However, newer types of tumblers of the disclosed kind are self-emptying, but here the bodies are discharged in a random manner and often in "clumps" together with the sawdust, which is swept together and fed manually back into the tumbler. But this does not change the fact that the tumbler must be stopped for filling with new, un-tumbled bodies and the used, collected sawdust, to which a fresh supply of sawdust has possibly been added, after which the tumbling is started anew. However, this type of tumbler can be used only for the tumbling of bodies, and is thus unusable for the tumbling of pelts, where use is made of a tumbler with an open wall structure like a gravel screen, where the sawdust which is added to the pelts after skinning and scraping is removed before the pelts are led away to be taned in the taning plant. This means that a pelt processing plant today must contain not only tumblers for tumbling the bodies from killed furred animals, but also another type of tumbler for tumbling of the pelts from these for removal of sawdust before the pelts are taned prior to the subsequent drying procedure.

Both the batch-wise mode of operation that the known body tumblers work in accordance with, where the tumbler must be stopped after each tumbling for the filling of new bodies, the feeding-back of sawdust, the fact that two types of tumblers are required in order to carry out the necessary handling of the pelts before they are taned and dried, and the fact that the tumbled bodies, when use is made of tumblers that are self-emptying, are discharged from the tumbler in a quite random manner, results in a great deal of manual work which it will be desirable to reduce. Moreover, since they are space-demanding, it will also be desirable to reduce the number of tumblers in the pelt processing plant.

With the invention it is realised that the above-mentioned problems can be eliminated with a tumbler of the kind disclosed by way of introduction, which is characterised in that the cavity in the tumbler between the filling opening and the discharge opening is divided into a number of sections, preferably two sections, to which the bodies are transferred by a conveyor unit which extends through the tumbler parallel with the longitudinal axis of the tumbler between the first and the second end walls.

It is hereby achieved that the tumbling procedure can be can be carried out in a continuous manner, in that "fresh" un-tumbled bodies can be continuously introduced through the filling opening, where they are tumbled in the first section, and after a certain period of time the tumbled bodies are transferred via the transport unit to the following section, where the tumbling is continued until the tumbling procedure (the determined tumbling time) comes to an end, after which the transport unit leads the bodies out through the discharge opening of the tumbler for further processing. In this manner it is thus not necessary for the tumbler to be stopped when it is emptied of bodies, inasmuch as there is simply carried out a continuous filling of the body tumbler with un-tumbled bodies.

SUMMARY OF THE INVENTION

With the object of being able to control the transfer of bodies between the respective sections during the tumbling of the bodies, the transport unit can comprise a conveyor belt with an open belt structure extending between the respective sections, where said conveyor belt is housed in an upwardly-open first cabinet with a lower bottom section, said cabinet and conveyor belt being partly covered by a number, corresponding to the number of sections, of pivotally-housed shields, where the positions of said shields are regulated by first actuators between a filling position, where one or a plurality of bodies are fed to the conveyor belt, and a closed position where no bodies are fed to the conveyor belt, said shields having an extent corresponding to the extent of the respective sections.

There is hereby achieved a controlled transfer of bodies between the different sections of the tumbler. During the tumbling, the bodies will be fed upwards along the sides of the tumbler by means of carriers on the inside of the tumbler, from where by gravitation the bodies fall down into the area where the conveyor belt is disposed, and will be fed further on the conveyor to the second section, where they fall down in the section for continued tumbling or for discharging. By displacing the pivotal shields to the closed position by means of the first actuator, the bodies in the section which are fed upwards by the tumbler's carreirs will merely fall down on the shields and further down in the tumbler, whereby the bodies remain in the relevant section. At the moment that, for example, the shield in the first section is displaced to the open position, the bodies which have fallen down will thus be transferred to the conveyor belt, and will be transported to the section for further tumbling or, as will be described later, they will be discharged individually through a discharge unit associated with the body tumbler according to the invention, which is placed at the end of the transport unit. The transport unit can consist, for example, of a conveyor belt of the type use for the conveying of potatoes.

With the object of being able to carry out a continuous feeding of sawdust during the operation of the body tumbler according to the invention, in the bottom section of the first cabinet there can be a worm conveyor, the feeding-in end of which is connected to a supply of a suitable particulate material, e.g. sawdust, and the discharge opening of which opens out in the section nearest to the tumbler's filling opening for bodies.

A continuous supply of fresh sawdust or other particulate material used is hereby made possible during the tumbling of the bodies.

With the further object of being able to regulate the supply of sawdust to and between the respective sections, the lower bottom part in each section, with the exception of the section nearest to the filling opening, can comprise an opening which is covered with a slide gate, and where the positions of the respective slide gates are regulated by other respective actuators, the positions of which are controlled by a control unit associated with the body tumbler.

It hereby becomes possible to carry out a regulation of the supply of sawdust to the respective sections, simply by opening a respective slide gate, whereby the sawdust transported by the worm conveyor will flow out through that or those openings where the slide gate(s) is/are displaced to the open position by a relevant actuator. It also becomes possible to re-circulate the sawdust and also to add fresh sawdust to the sawdust re-circulated. The possibility is thus achieved for a total control and optimisation of the amount of sawdust consumed in the tumbling, at the same time that the tumbler remains in continuous operation. Furthermore, the work involved in the moving of sawdust, including the adding of portions of new sawdust, which according to the known technique is carried out manually, is hereby eliminated.

With the object of facilitating the supply of bodies to the body tumbler according to the invention, the end wall facing away from the tumbler's cavity comprising the filling opening for bodies, can be provided with an inclined first chute with side walls for the receiving of bodies in bulk, which via the chute are fed to the tumbler.

Bodies which are to be tumbled can hereby be fed to the tumbler in bulk by simple tipping, with the transport unit, or from a specially arranged carriage, so that an actual manual handling of the bodies becomes superfluous.

Namely with the subsequent handling of the bodies after tumbling, it can be of great significance to be able to carry out the discharging of the bodies from the tumbler in a controlled manner, so that the bodies are discharged individually and with a more or less uniform orientation, and herewith be able to spare manual labour.

With the object of ensuring a controlled discharging of tumbled bodies from the tumbler according to the invention, it can further comprise a discharge arrangement for individual discharge of tumbled bodies, said discharge arrangement being disposed in the delivery opening in the second end wall in immediate extension of the conveyor.

Without renouncing other forms of discharging arrangement, it can be mentioned that this can with advantage comprise a pivotally-housed plate, the free end of which opposite the housing is lying in immediate extension of the delivery end of the conveyor, where said pivotal plate is pivotally-housed on the upper edge of a second chute with side limits which opens out in the closest-lying section of the tumbler cavity, and where the position of the free end of the pivotal plate is regulated by a third actuator between a discharge position for individual delivery of bodies, where the free end of the plate is lying on a level with or slightly under the delivery end of the conveyor, and a feed-back position for bodies, where the free end of the plate is displaced by the third actuator to a position lying on a level above the delivery end of the conveyor.

There can hereby be carried out a controlled discharge of the bodies from the body tumbler, so that one body at a time is discharged, which is fed further from the discharge opening for further processing in a manner not disclosed in more detail. However, it can be mentioned that a further feeding of the discharged bodies can be effected by means of a conveyor or the like.

With the object of being able to register/identify which bodies are present in the body tumbler, and/or which bodies are discharged from the tumbler, at its filling opening and/or at the delivery opening there can be an electronic/optical reading unit for the scanning of an electronically/optically readable data media secured to an actual body, said data media containing identification data associated with the actual body.

It will hereby be possible to carry out a location of the relevant body, at the same time that the possibility is opened for a central registration of how far an actual body has reached in the production procedure between slaughtering to tumbled pelt.

It can also be mentioned that the speed of rotation of the tumbler, the position of the slide gates, the speed of the conveyor, the speed of the worm conveyor, the supply of clean/new particulate material to the feed-in opening of the worm conveyor, the positioning of the pivotal plate on the discharge arrangement, can with advantage be controlled and regulated by a control unit associated with the body tumbler.

It is hereby achieved that the speed of rotation of the tumbler can be adjusted to suit the type of body which is handled in the tumbler, and also that the amount of added sawdust can be adjusted to the actual tumbling task, just as sawdust can be removed from the tumbler. Moreover, the discharging of the tumbled bodies or pelts can take place at a desired speed, all depending on the capacity of that unit which shall receive them.

With the object of ensuring a good working environment around the body tumbler according to the invention, this can be encapsulated in a cabinet to which a suction plant with associated filter unit is connected.

It is hereby achieved that an under-pressure is created inside the cabinet/the tumbler, which ensures that dust arising inside the tumbler during the tumbling of the bodies does not escape out into the room in which the tumbler is standing. The problem regarding the working environment which is known from the known tumblers is hereby solved.

It shall also be mentioned that with the arrangement of the body tumbler according to the invention, where it is possible to control the supply of sawdust, and to remove same from the cavity of the tumbler, is not only suitable for the tumbling of bodies of furred animals and the tumbling of pelts with the leather side outermost (scraped pelts), but also for the tumbling of pelts with the fur side outermost before these are led to the taning room for taning and subsequent drying. With the tumbler according to the invention, there is thus provided a tumbler which is universally applicable for all of the tumbling tasks which arise in connection with the production of pelts from furred animals.

In the following, the invention is explained in more detail with reference to the drawing, where

DETAILED DESCRIPTION OF THE INVENTION

Figure 1:
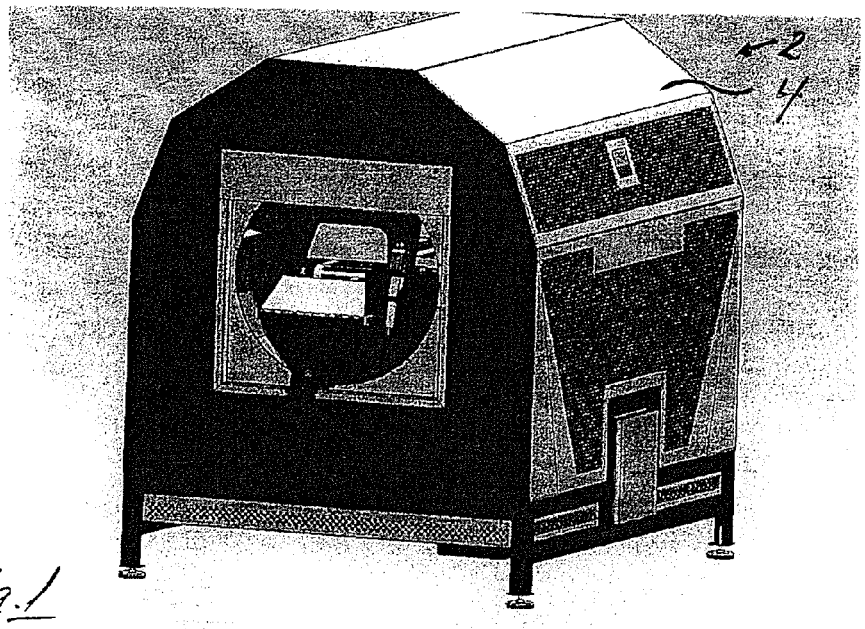
FIG. 1 is a perspective view of a body tumbler shown with cabinet according to the invention, seen at an angle from the delivery end.
Figure 2:
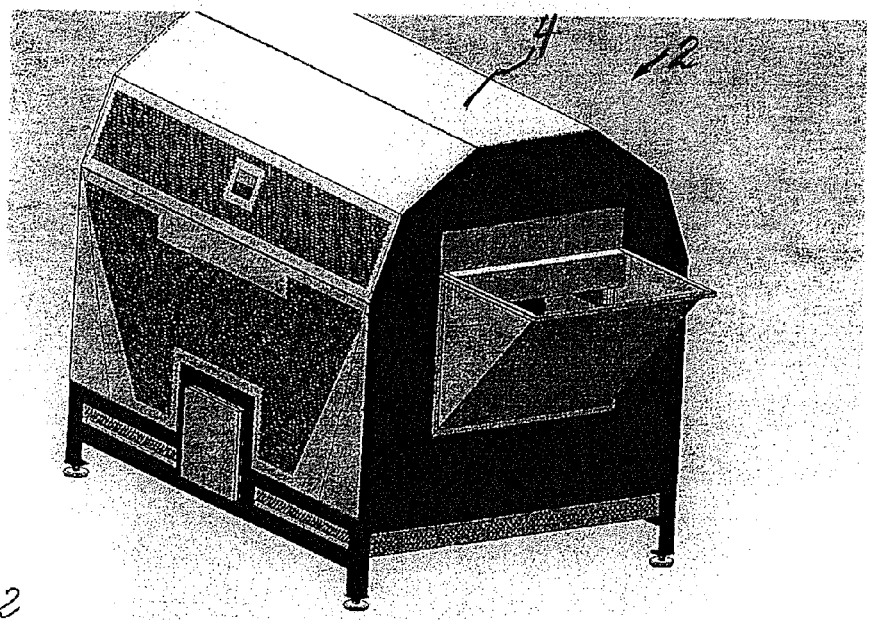
FIG. 2 is a perspective view of a body tumbler shown with cabinet according to the invention, seen at an angle from the filling opening.

In FIGS. 1 & 2, there is shown a first embodiment of a body tumbler 2 according to the present invention, showing cabinet 4 to which there is coupled a not-shown suction plant connected with a not-shown filter unit for the filtering of dust and possible odours from the sucked-out air.

Figure 3:
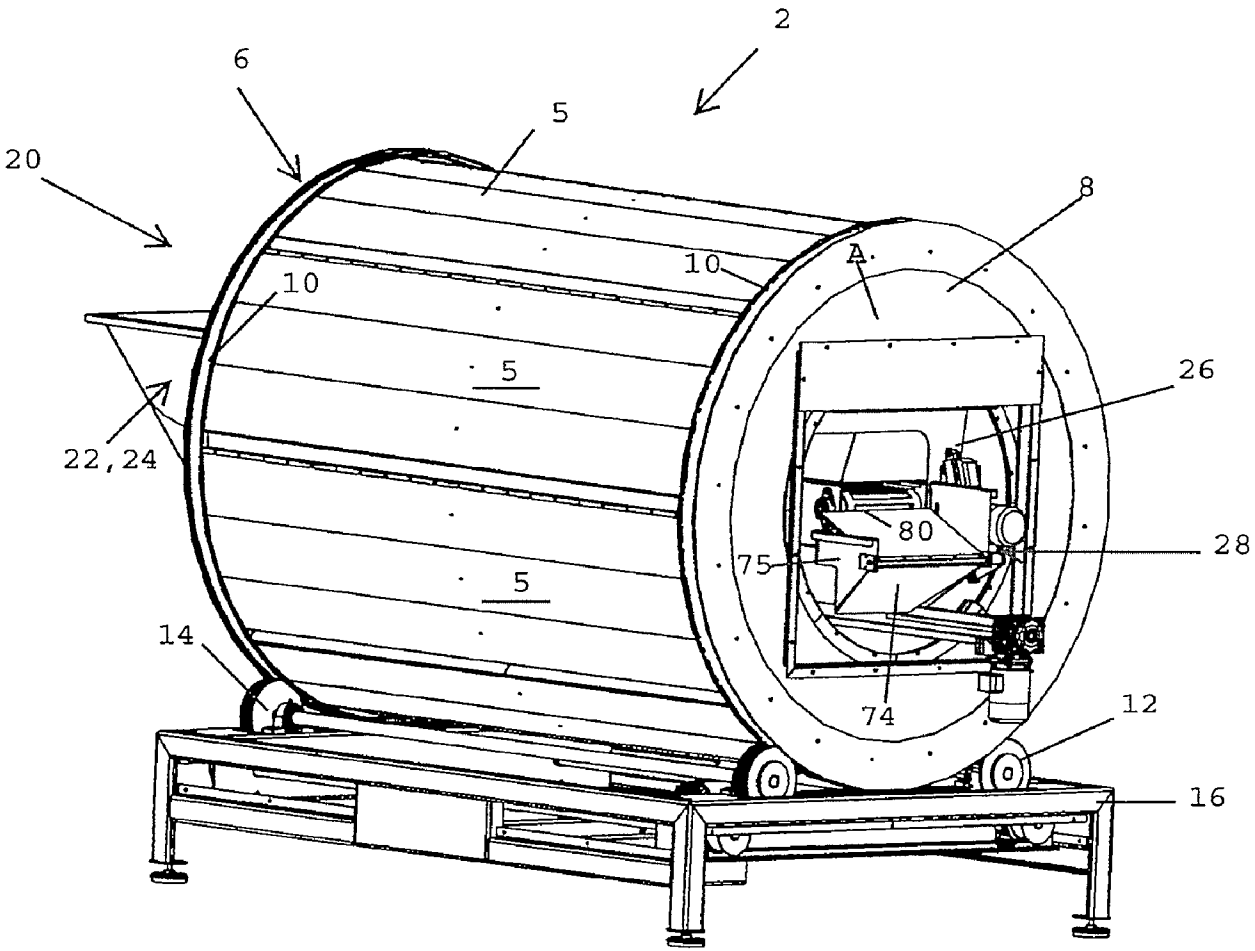
FIG. 3 is a perspective view of a body tumbler according to the invention, where the cabinet is removed, seen at an angle from the delivery end.

In FIG. 3 is seen a perspective view of the embodiment of the body tumbler 2 shown in FIGS. 1 & 2, but where the cabinet has been removed. As will appear from FIG. 3, the tumbler 2 comprises a number of segments 5 which, together, form an approximately cylindrical, horizontally-oriented tube, the ends of which are annular plates 6, 8 (cf. FIG. 6) which respectively constitute the first and the second end walls of the body tumbler 2. The end walls 6, 8 are reinforced in the ends so that they hereby form support surfaces 10 where the tumbler 2 is supported by a set of drive wheels 12 and a set of support wheels 14 which are housed on an under-frame 16 on which the tumbler's drive motor 18 (cf. FIG. 4) is mounted. The tumbler comprises internal carriers 19 (cf. FIG. 6) in the joint lines between the segments 5 which extend into the cavity 21 of the tumbler, and during the rotation of the tumbler the bodies are led upwards by and with the carriers, from where they fall down under gravitation.

Figure 4:
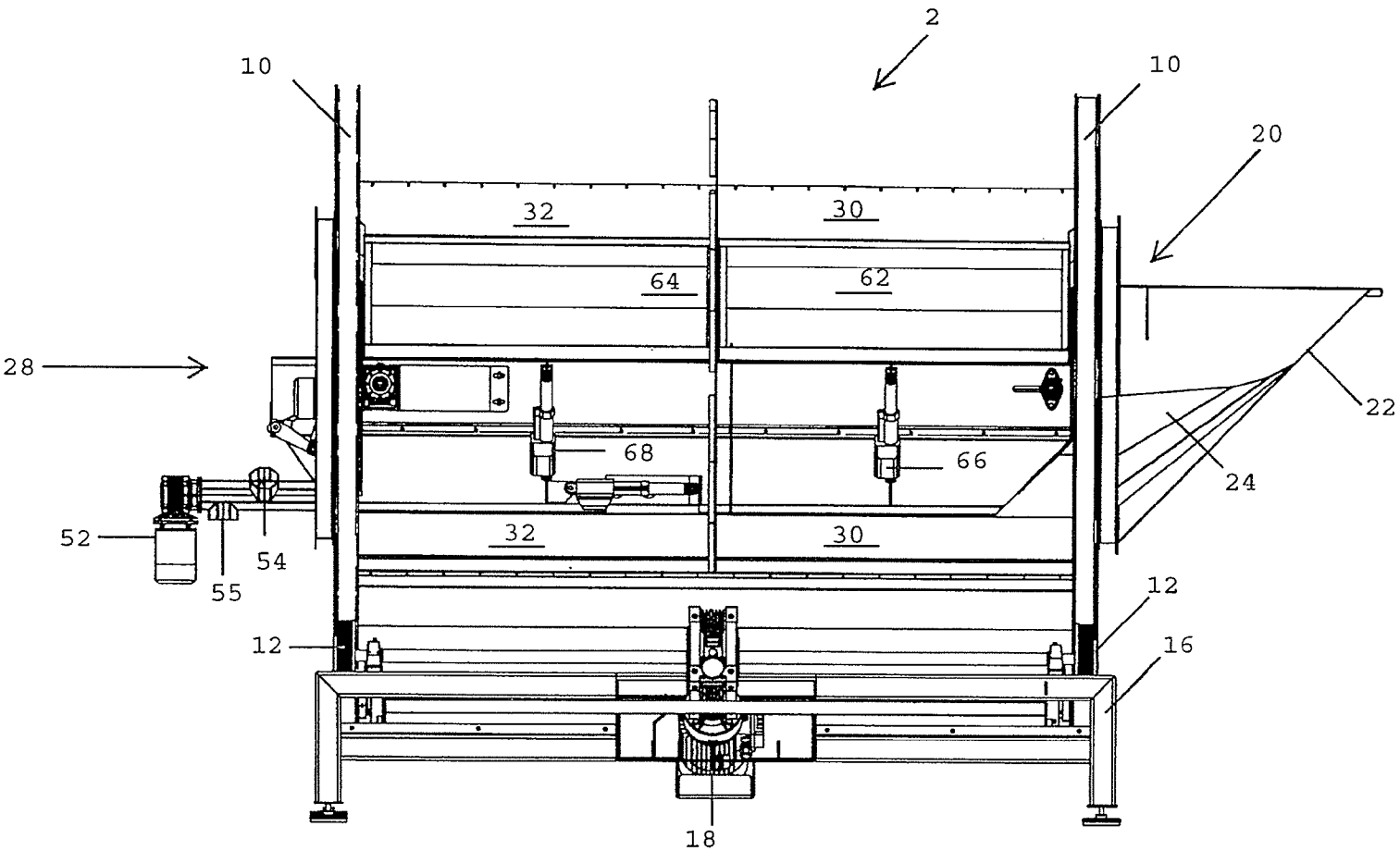
FIG. 4 is a side view of that shown in FIG. 3, but where a part of the wall of the body tumbler is removed.

The first end wall 6 comprises a filling opening 20, and on the under-frame 16, in front of the filling opening and sloping towards the cavity of the tumbler, there is placed a chute 22 which comprises side walls 24, as will appear from FIGS. 3 & 4.

The second end wall 8 comprises a delivery opening 26 where, on the under-frame 16 in the delivery opening 26, there is placed a discharge arrangement 28 which will be described in more detail later.

Figure 5:
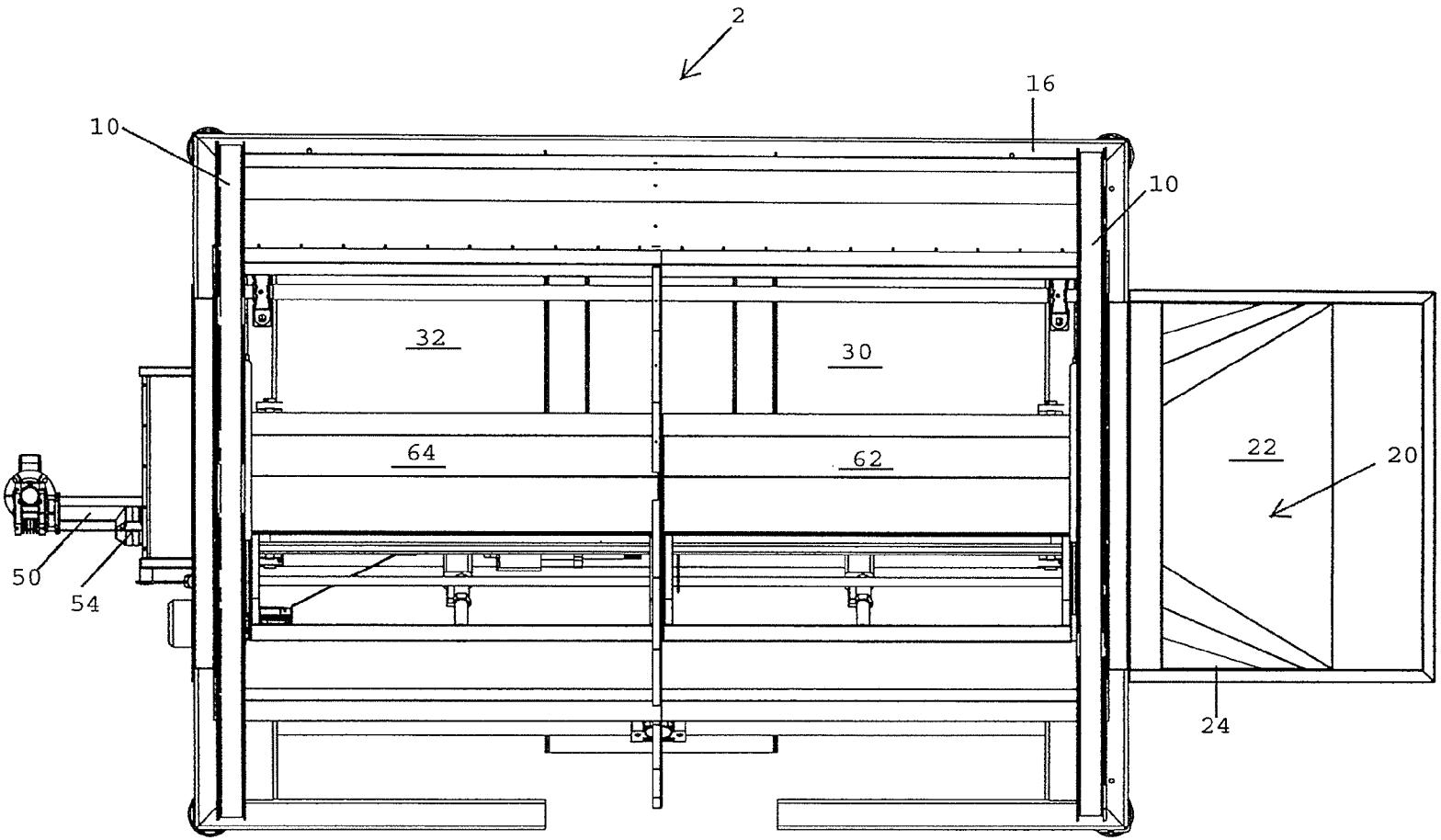
FIG. 5 is a view seen from above of the body tumbler shown in FIG. 3, but where a part of the wall of the body tumbler is removed.
Figure 6:
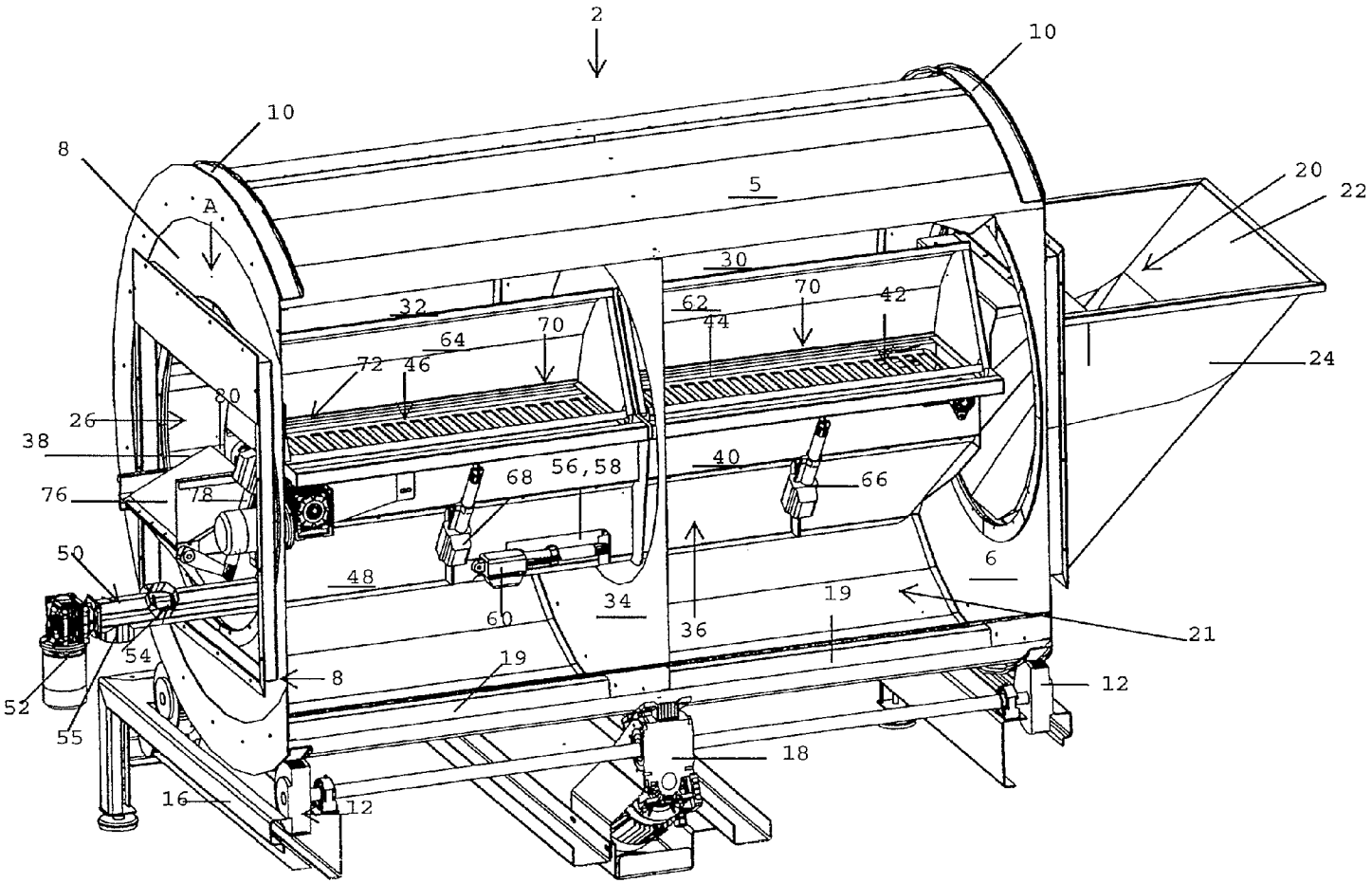
FIG. 6 is a perspective sectional view of the body tumbler shown in FIGS. 3-5.

As will appear from FIGS. 4-6, the tumbler cavity 21 is divided into a first section 30, which lies nearest to the filling opening 20, and a second section 32, which lies nearest to the delivery opening 26. The division is effected practically by an annular plate 34, which is placed in the centre of the tumbler. The direction of rotation of the tumbler is indicated by the arrow A, cf. FIG. 6.

As will also appear namely from FIG. 6, the body tumbler in the shown embodiment comprises a transport unit 36 which extends parallel with the tumbler's horizontal longitudinal axis 38 between near the first end wall 6 to near the second end wall 8. The transport unit 36 comprises an upwardly-open cabinet 40, in the opening 42 of which there is a conveyor 44 with a belt 46 which has an open structure.

The cabinet 44 also comprises a lower bottom section 48 which is open upwards towards the conveyor belt, the geometry of which corresponds to the geometry of an internally-extending worm conveyor 50, preferably of the flex type, the drive motor 52 for which and the feed-in opening 54 for fresh sawdust/particulate material from a not-shown supply, and a delivery opening 55 for removal of sawdust, are placed in the lower half part of the delivery opening 26.

This construction has the result that sawdust which is supplied to the conveyor 44 will fall through the open structure in the conveyor belt 46, and by gravitation will be led to the bottom section 48 and herewith to the worm conveyor, whereby the sawdust can be fed back to the first section 30 of the tumbler, possibly with an addition of fresh sawdust. Sawdust can also be introduced into the second section 32 via an opening 56 in the bottom section 48, which in FIG. 6 is shown covered by a slide gate 58, the position of which is regulated by an actuator 60 whose movements are controlled by a control and regulation unit (not shown) associated with the body tumbler. By displacement of the slide gate 58 to an open position, sawdust which is transported with the worm conveyor 50 will run out through the opening 56 in the bottom section 48, and out in the second section 32.

As will appear from FIG. 6, the conveyor 44 is partly covered by pivotally-housed shields 62, 64 respectively in the first section 30 and the second section 32. The shields 62, 64 can be tilted by means of other actuators 66, 68 between a closed position as shown in FIG. 6, and a filling position, where the shields 62, 64 independently of each other (all depending on which section 30, 32 of the tumbler 2 shall be emptied of bodies) can be tilted away from contact with that side 70 of the cabinet 40 which is oriented towards the direction of rotation A of the tumbler, and bodies (not shown) which are led upwards along the periphery of the tumbler by the carriers 19 will fall down on to the conveyor belt 46 and be led by this in the direction of the conveyor's delivery end 72, where the bodies will either be fed to the second section 32 via a chute 74 (cf. FIG. 3) or will be discharged through the discharge opening 28 (cf. FIG. 3) at the delivery end 72 of the conveyor. Sawdust which will hereby also fall down on the conveyor belt 46 will continue through its open structure and be fed to the worm conveyor 50 in the bottom section 48.

The discharge arrangement 28 consists of a chute 74 to which a plate 76 is connected in a pivotal manner, where the position of said pivotal plate 76 is regulated by a third actuator 78 between a discharge position for individual discharge of bodies, where the free end 80 of the plate lies on a level with or slightly under the delivery end 72 of the conveyor 44, whereby the bodies are discharged individually, and a leading-back position for bodies, where the free end 80 of the plate 76 is displaced by a third actuator 78 to a position lying on a level above the delivery end 72 of the conveyor, whereby the bodies are led to the second section 32 of the tumbler.

In the above description, bodies of furred animals are used as an example of the items which shall be handled in the tumbler 2 according to the invention, but as already mentioned, the tumbler can also be used for the tumbling of pelts with leather side outermost, after scraping, or the tumbling of pelts with the fur side outermost, while at the same time the amount of sawdust in the respective sections can be controlled, and also in such a manner that the pelts are discharged individually from the tumbler via the discharge arrangement 28.

What is claimed is:

1. Tumbler for tumbling of bodies of dead furred animals, comprising:

a horizontally-oriented substantially cylindrical tube formed of a first end wall, a second end wall and inner wall formed of a plurality of carriers, and with a cavity provided therein defined between the first end wall, the second end wall of the tube and said inner wall, and being provided with a filling opening for bodies, and a delivery opening, and a motor-driven drive mechanism by which said cylindrical tube is rotatable around a horizontally-oriented longitudinal axis thereof, a conveyor unit extending through the tumbler parallel to said longitudinal axis between the first end wall and the second end wall, supply means for supplying a liquid-absorbing particulate material suitable for removing saliva, urine and feces from dead animal bodies into an area of said cylindrical tube in which the bodies are located during tumbling, and removal means for removing the liquid-absorbing particulate material from said cylindrical tube after passage through said area of the cylindrical tube, wherein, between the filling opening and the delivery opening, the cavity is divided into a number of sections to which the bodies are transferred by the conveyor unit.

2. Tumbler according to claim 1, wherein the conveyor unit comprises a conveyor with a conveyor belt extending between the respective cavity sections, wherein the conveyor belt has an open structure, wherein said conveyor is housed in an upwardly-open first cabinet with a lower bottom section, wherein said cabinet and the conveyor belt are partially covered by a plurality of pivotally-housed shields corresponding in number to the number of cavity sections, and the positions of said shields being regulated by a first actuator between a filling position feeding bodies to the conveyor belt, and a closed position in which bodies are not fed to the conveyor belt, said shields having a length corresponding to the length of the respective cavity sections.

3. Tumbler according to claim 2, wherein said supply means is located in the lower bottom section of the first cabinet and comprises a worm conveyor with a feed-in opening which is connected to a supply of said particulate material, and a discharge opening which opens into a one of the cavity sections nearest to the filling opening.

4. Tumbler according to claim 3, wherein said removal means comprises an opening which is covered by a slide gate in a lower bottom section in each cavity section except for the cavity section nearest to the filling opening of the tumbler, and wherein the position of the respective slide gates is regulated by respective second actuators, the positions of which are controlled by a control unit.

5. Tumbler according to claim 1, wherein an outwardly facing side of the end wall having the filling opening is provided with an inclined first chute with side walls for receiving bodies in bulk feeding the bodies to the cavity.

6. Tumbler according to claim 4, further comprising a discharge arrangement for individually discharging of tumbled bodies, said discharge arrangement being disposed in the delivery opening in the second end wall as an immediate extension of the delivery end of the conveyor.

7. Tumbler according to claim 6, wherein the discharge arrangement comprises a pivotally-mounted plate, a free end of which opposite the pivotal mounting lies as an immediate extension of the delivery end of the conveyor, said pivotally-mounted plate being pivotal on an upper edge of a second chute with side walls which opens out in a nearest-lying cavity section, and wherein the position of the free end of the pivotally-mounted plate is regulated by a third actuator between a discharge position for discharging of bodies individually, wherein the free end of the plate lies on a level slightly under the delivery end of the conveyor, and a feed-back position for bodies, and wherein the fee end of the plate is displaceable by the third actuator to a position lying on a level above the delivery end of the conveyor.

8. Tumbler according to claim 1, wherein at least one of filling opening and the delivery opening is provided with an electronic/optical scanning unit for scanning of an electronically/optically readable data medium secured to each body, said data medium containing identification data associated with the relevant body.

9. Tumbler according to claim 7, where the speed of rotation of the tumbler, the position of the slide gates, the speed of the conveyor belt, the feeding speed of the conveyor, the supply of clean/Previously Presented particulate material to the feed-in opening of the conveyor, the positioning of the pivotally mounted plate are controlled and regulated by said control unit.

10. Tumbler according to claim 1, further comprising a cabinet which encloses the cylindrical tube and a suction plant with an associated filter unit which is connect to said cabinet.

11. Tumbler according to claim 1, wherein the supply means is located above the conveyor unit, wherein the removal means is located below said conveyor unit, and wherein said conveyor unit comprises a conveyor belt with an open structure through which said particulate material can pass from said supply means to said removal means.

12. Tumbler according to claim 1, wherein liquid-absorbing particulate material comprises sawdust.

* * * * *